US007057572B2

(12) United States Patent
Lee et al.

(10) Patent No.: US 7,057,572 B2
(45) Date of Patent: Jun. 6, 2006

(54) HORN ANTENNA SYSTEM HAVING A STRIP LINE FEEDING STRUCTURE

(75) Inventors: Tae Yune Lee, Seoul (KR); Nak Seon Seong, Daejon (KR); Ji-Hoon Bae, Daejon (KR); Jong Suk Chae, Daejon (KR); Jae Ick Choi, Daejon (KR)

(73) Assignee: Electronics and Telecommunications Research Institute, (KR)

( * ) Notice: Subject to any disclaimer, the term of this patent is extended or adjusted under 35 U.S.C. 154(b) by 0 days.

(21) Appl. No.: 10/700,422

(22) Filed: Nov. 3, 2003

(65) Prior Publication Data

US 2004/0095286 A1 May 20, 2004

(30) Foreign Application Priority Data

Nov. 2, 2002 (KR) ..... 10-2002-0067673
Sep. 29, 2003 (KR) ..... 10-2003-0067344

(51) Int. Cl.
*H01Q 13/00* (2006.01)

(52) U.S. Cl. ..... 343/786; 344/774

(58) Field of Classification Search ..... 343/786, 343/776, 772, 773, 774
See application file for complete search history.

(56) References Cited

U.S. PATENT DOCUMENTS 5,517,203 A * 5/1996 Fiedziuszko ..... 343/756
5,617,108 A * 4/1997 Silinsky et al. ..... 343/786
5,784,033 A * 7/1998 Boldissar, Jr. ..... 343/786
5,995,057 A * 11/1999 Faith et al. ..... 343/781 R
6,198,454 B1 * 3/2001 Sharp et al. ..... 343/773
6,313,808 B1 * 11/2001 Yuanzhu ..... 343/786
6,346,920 B2 * 2/2002 Sharp et al. ..... 343/773
6,714,166 B2 * 3/2004 Sasaki et al. ..... 343/785
2003/0214450 A1 * 11/2003 Lynch et al. ..... 343/772

FOREIGN PATENT DOCUMENTS

JP 05-018102 1/1993
JP 06-334431 12/1994
JP 07-212124 8/1995
JP 08-195620 7/1996

OTHER PUBLICATIONS

Ka Band Phased Array Antenna for Satellite Communications, 7 pages.

* cited by examiner

*Primary Examiner*—Don Wong
*Assistant Examiner*—Hung Tran Vy
(74) *Attorney, Agent, or Firm*—Blakely, Sokoloff, Taylor & Zafman

(57) ABSTRACT

A horn antenna system having a strip line feeding structure of which size is reduced while cross polarized characteristics are kept. The horn antenna system, includes: a first horn antenna unit having a first horn antenna and a first ground made of metal, for radiating a signal; a second horn antenna unit having a second horn antenna and a second ground made of metal, for reflecting the signal to allow the second horn antenna unit to radiate the signal; and a feeding unit located between the first horn antenna unit and the second horn antenna unit, for feeding the energy to the first horn antenna unit and the second horn antenna unit, wherein the feeding unit is a stripe line.

5 Claims, 5 Drawing Sheets

HORN ANTENNA SYSTEM HAVING A STRIP LINE FEEDING STRUCTURE

FIELD OF THE INVENTION

The present invention relates to a horn antenna system for satellite communications; and, more particularly, to a horn antenna system having a strip line as a feed line.

DESCRIPTION OF RELATED ART

Generally, a horn antenna is used to excite a signal at a open end of a waveguide. Then, the signal is transmitted from the closed end to an open end on the waveguide and energy is radiated from the open end of the waveguide to the air. In the mean time, a part of energy is reflected because the waveguide and the air are not impedance-matched. Therefore, a flared horn is used to match the impedances of the waveguide and the air, and energy is radiated at the open end of the waveguide. The horn antenna is commonly used for the transmission and reception of microwave signals and particularly used for exciting energy and testing of a parabola antenna.

FIG. 1 is a block diagram showing a conventional horn antenna system. As shown, the horn antenna system includes a horn antenna 101 and a polarizer 102.

The polarizer 102 generates a circularly polarized wave from a waveguide in a microwave region by positioning dielectric plane having a width of ¼λ on the midpoint of a circular waveguide at 45°. Since the size of the waveguide is large, it is difficult to make the horn antenna small.

In order to solve the problem mentioned above, a technique is disclosed in Japanese Laid-Open Patent application No. 1995-212124 entitled "Feed horn for circularly polarized wave".

Referring to the patent application mentioned above, the length of the waveguide in a horn antenna is shortened and the horn antenna can be used for both the left hand circularly polarized wave (LHCP) and the right hand circularly polarized wave (RHCP). Also, the horn antenna is fed by the microstrip device located at the end of the waveguide. However, the size of the horn antenna cannot be reduced because the waveguide is included in the horn antenna.

SUMMARY OF THE INVENTION

It is, therefore, an object of the present invention to provide a horn antenna system of which size is reduced while cross polarized characteristics are being kept.

In accordance with one aspect of the present invention, there is provided a horn antenna system, including: a first horn antenna unit having a first horn antenna and a first ground made of metal, for radiating a signal; a second horn antenna unit having a second horn antenna and a second ground made of metal, for reflecting the signal to allow the first horn antenna unit to radiate the signal; and a feeding unit located between the first horn antenna unit and the second horn antenna unit, for feeding the energy to the first horn antenna unit and the second horn antenna unit, wherein the feeding unit is a stripe line.

In accordance with another aspect of the present invention, there is provided a horn antenna system having a first horn antenna unit having a first horn antenna and a first ground made of metal, for radiating a signal; and a second horn antenna unit having a second horn antenna and a second ground made of metal, for reflecting the signal to allow the second horn antenna unit to radiate the signal, including: feeding unit located between the first antenna unit and the second antenna unit, for feeding the first antenna unit and the second antenna unit, wherein a ground plane of the feeding unit is the first ground unit and second ground unit.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE INVENTION

Other objects and aspects of the invention will become apparent from the following description of the embodiments with reference to the accompanying drawings, which is set forth hereinafter.

Figure 1:
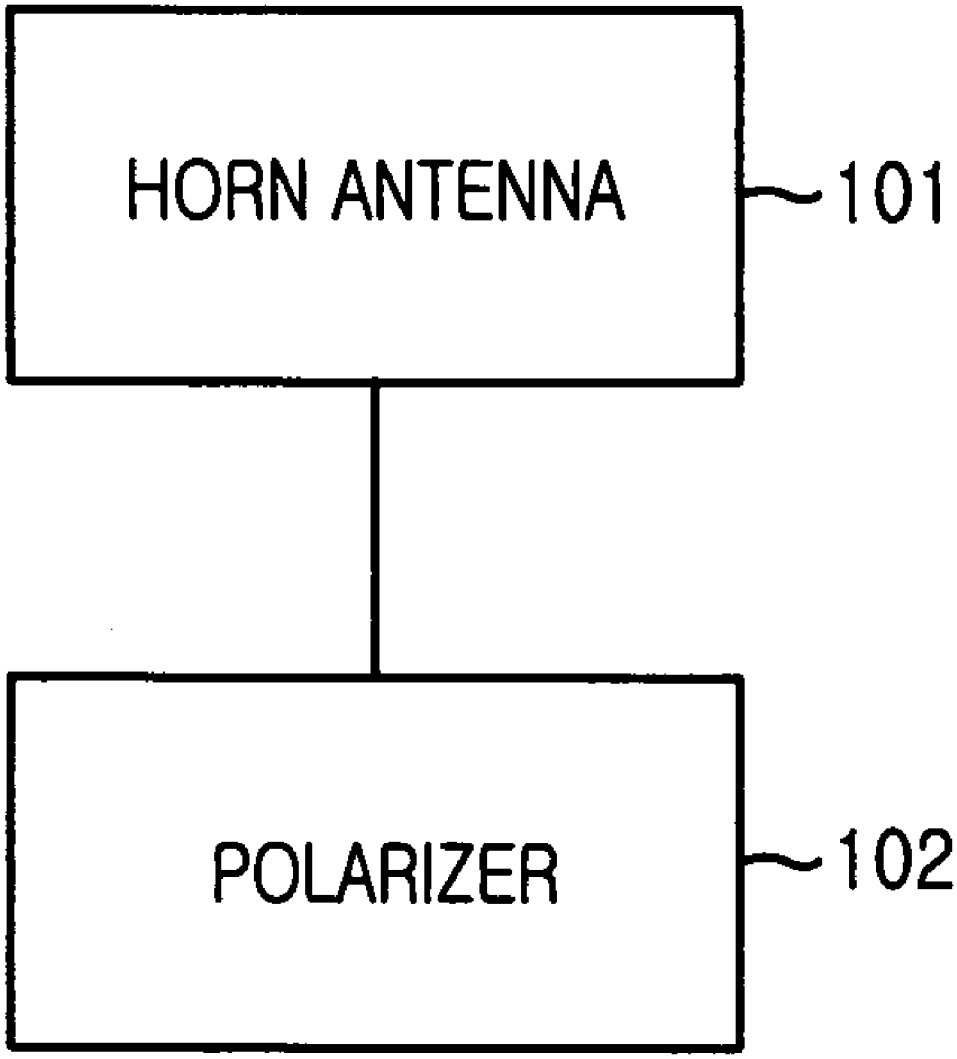
FIG. 1 is a block diagram showing parts of a horn antenna system.
Figure 2:
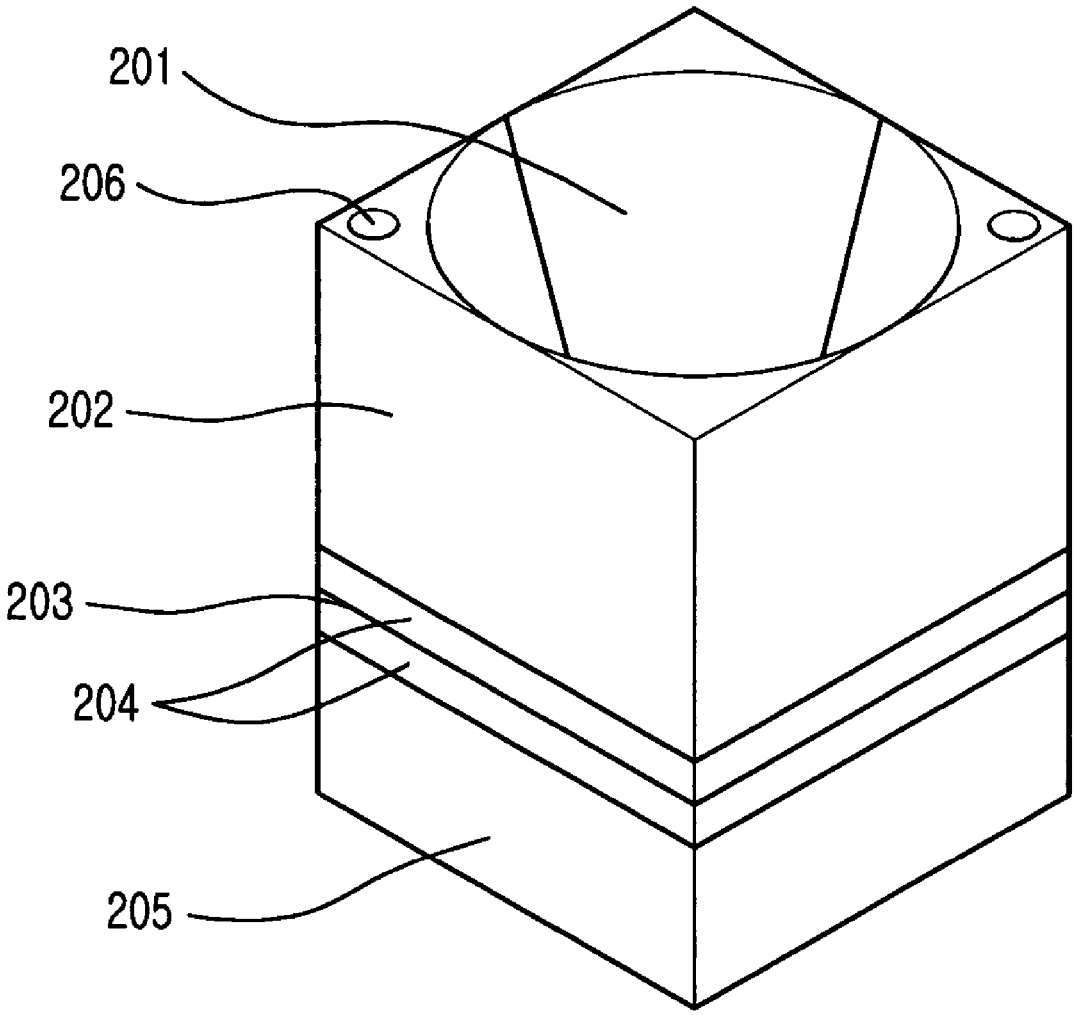
FIG. 2 is a side view showing a horn antenna system having a feeding unit in accordance with the present invention.

FIG. 2 is a projection view showing a horn antenna system having a feeding unit in accordance with the present invention.

Referring to FIG. 2, the horn antenna system includes a horn antenna 201 for radiation, an upper ground plane 202, a feed line 203, a dielectric layer 204, a lower ground plane 205 and a metal bolt 206.

Each of the upper ground plane 202 and the lower ground plane 205 is a rectangular parallelepiped and made of metal. The horn antenna 201 for radiation is located in the upper ground plane 202. A horn antenna for reflection, which is not shown in FIG. 2, is located in the lower ground plane 205. The horn antenna for reflection will be described with reference to FIG. 3. The upper ground plane 202 and the lower ground plane 205 are depicted as a rectangular parallelepiped in accordance with the preferred embodiment of the present invention. However, various form such as cylindrical or cubic structure can be employed as the upper ground plane 202 and the lower ground plane 205.

The feed line 203 having a strip line structure is located below the upper ground plane 202 and over the lower ground plane 205. The feed line 203 feeds both of the horn antenna 201 for radiation and the horn antenna 301 for reflection.

As a ground plane of the feed line 203, the upper ground plane 202, the lower ground plane 205, the ground plane of the horn antenna for radiation, or the ground plane of the horn antenna for reflection can be used.

Various designs of the feed line can be employed to obtain linear polarized wave or circularly polarized wave.

The metal bolt 206 electrically connects the upper ground plane 202 and the lower ground plane 205. Various methods for connecting the upper ground plane 202 and the lower ground plane 205 can be used instead of connecting the upper ground plane 202 and the lower ground plane 205 by using the metal bolt 206.

The horn antenna is described in a conical from in the present invention, however, various forms of antennas can be used as the horn antenna. Any material that is electrical conductor can be used as the upper ground plane 202 and the lower ground plane 205.

The dielectric layer 204 is placed between the upper ground plane 202 and the lower ground plane 205.

Figure 3:
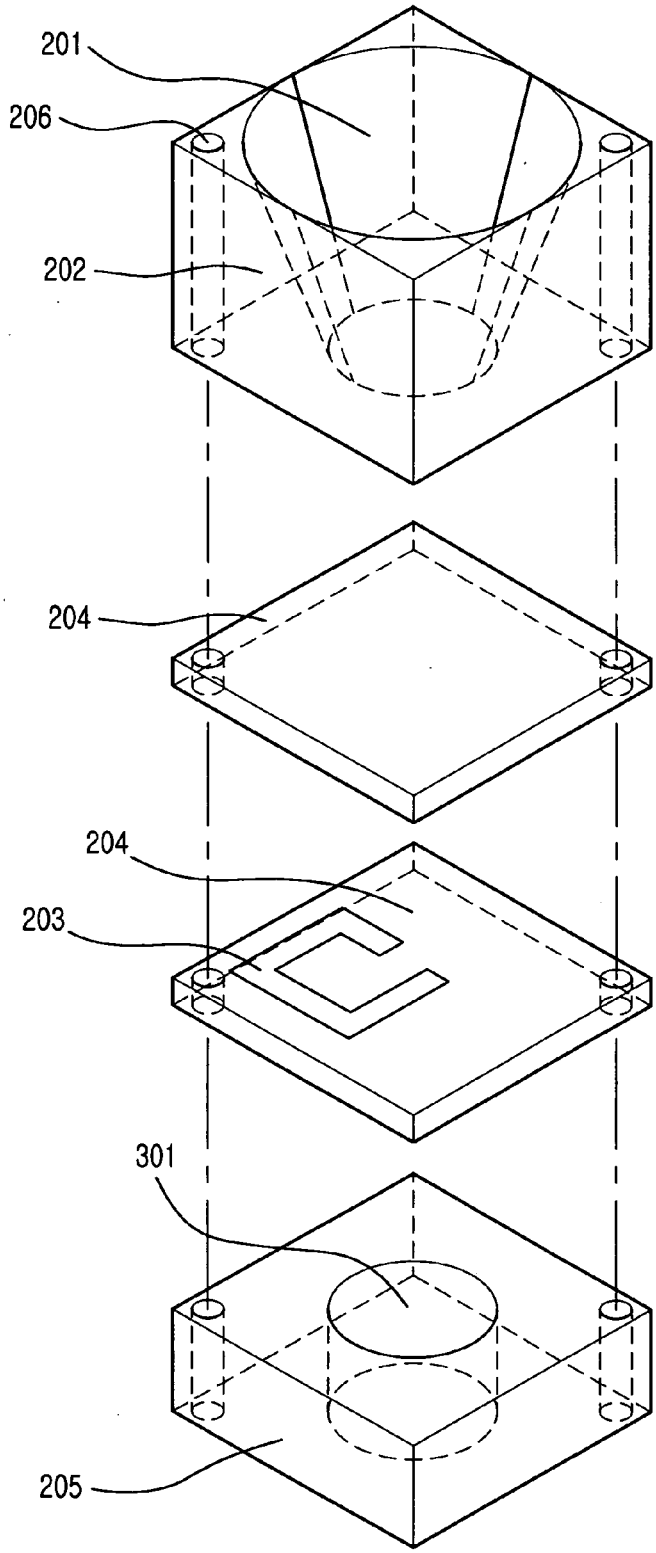
FIG. 3 is an exploded view showing a horn antenna system having a feeding unit in accordance with the present invention.
Figure 4:
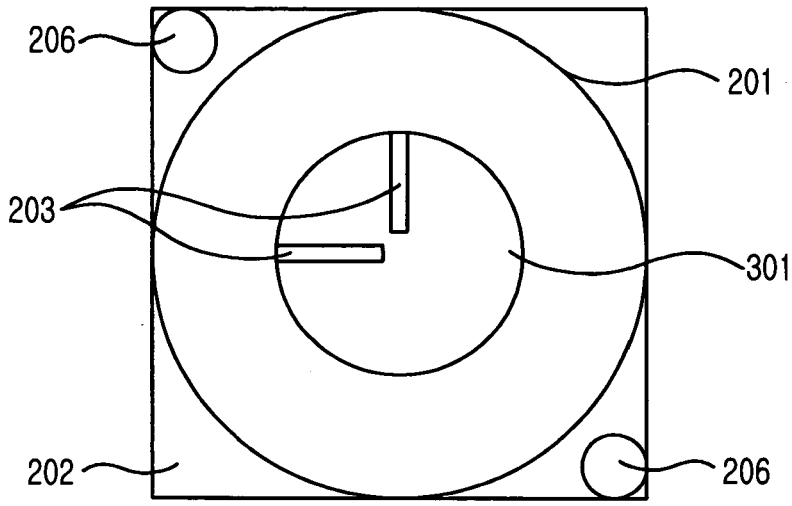
FIG. 4 is a top view a horn antenna system having a feeding unit in accordance with the present invention.
Figure 5:
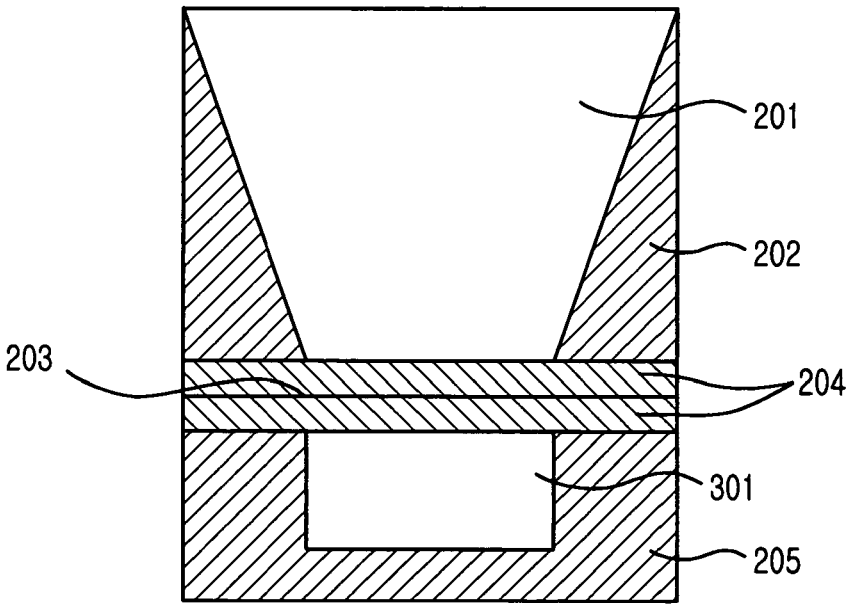
FIG. 5 is a cross sectional view a horn antenna system having a feeding unit in accordance with the present invention.

FIG. 3 is an exploded view showing the horn antenna system shown in FIG. 2. FIG. 4 is a top view a horn antenna system having a feeding unit in accordance with the present invention. FIG. 5 is a cross-sectional view a horn antenna system having a feeding unit in accordance with the present invention.

Referring to FIGS. 3 to 5, a first layer is the upper ground plane 202 in which the horn antenna for radiation is located. The upper ground plane 202 is made of metal and has a form of rectangular parallelepiped.

A second layer is the upper part of the dielectric layer 204. As described in FIG. 2, the dielectric layer 204 is used as a board of a microstrip line and any material generally used for the dielectric layer can be used. A metal plane of the dielectric layer can be used as a ground plane of the feed line 203 and the ground plane of the horn antenna for radiation/reflection can be used as a ground plane of the feed line 203.

A third layer includes a lower part of the dielectric layer 204 and the feed line 203. Herein, various designs of the feed line 203 can be used to induce required polarized wave such as a linear polarized wave and a circular polarized wave, and various feeding method such as microstrip feeding or coaxial cable feeding can be applied instead of a stripline structure.

A forth layer is the lower ground plane 205 in which the horn antenna for reflection 301 is located. The lower ground plane 202 is made of metal and has a form of rectangular parallelepiped. The horn antenna 301 for reflection reflects a current fed from the feed line 203. A signal is reflected on the horn antenna 301 for reflection and radiated on the horn antenna 201 for radiation.

A metal bolt connects the upper ground plane 202 and the lower ground plane 205 electrically. Various methods for connecting the top ground plane and the bottom ground plane can be considered instead of the method of the present invention. Stable connection between ground plane of the antenna feeder and the ground of the interior circuit is necessary.

The horn antennas for radiation/reflection 201 and 301 are described in the conical form. However, a horn antenna having a waveguide form can be used. Any kind of material that has electrical conductivity can be used as the upper ground plane 202 and the lower ground plane 205.

Figure 6:
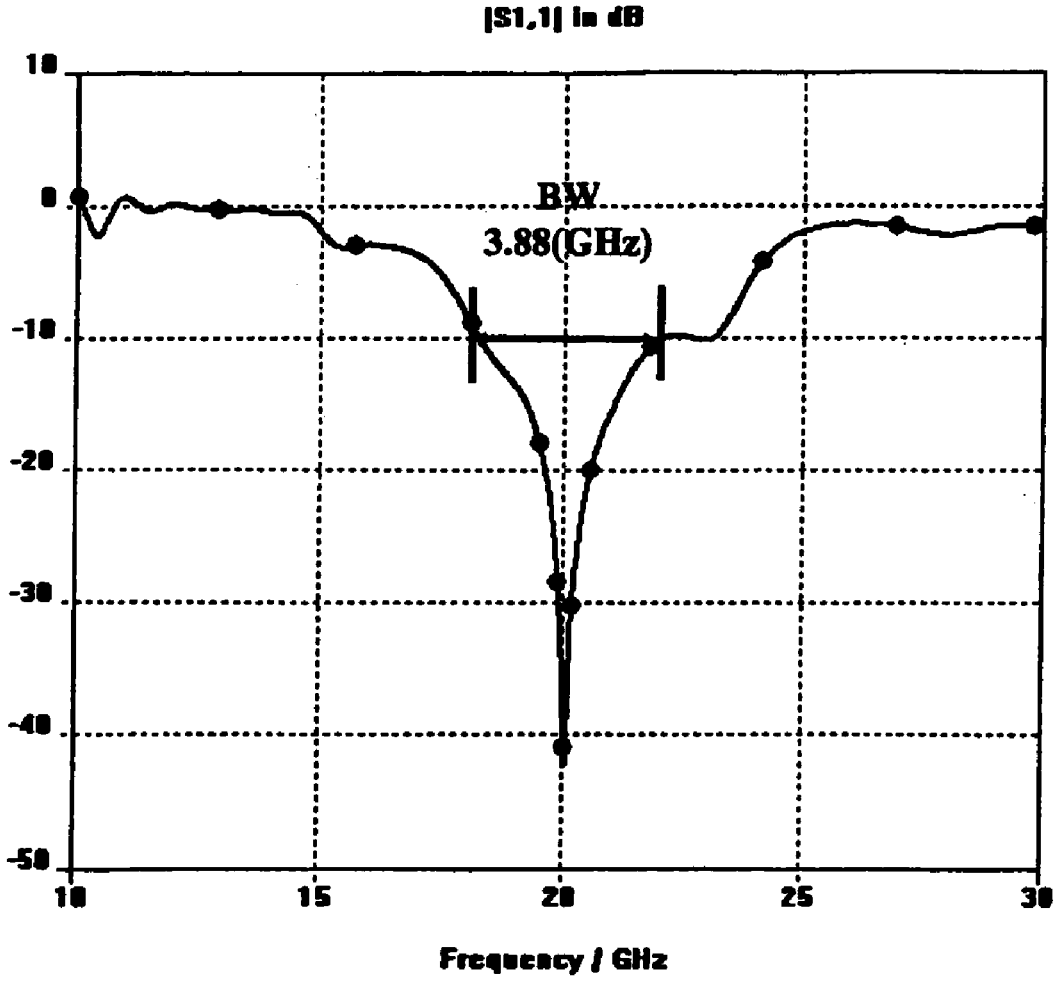
FIG. 6 is a graph showing reflection characteristics of the horn antenna in accordance with the present invention.

FIG. 6 is a graph showing reflection characteristics of the horn antenna system in accordance with the present invention.

Referring to FIG. 6, the horn antenna resonates at 20 GHz and has a bandwidth of 3.88 GHz.

The present invention can reduce the size of the antenna structure and provide a simple feeding method by using the strip line feeding structure instead of using additional parts for feeding the horn antenna while having cross polarized characteristics.

While the present invention has been shown and described with respect to the particular embodiments, it will be apparent to those skilled in the art that many changes and modifications may be made without departing from the spirit and scope of the invention as defined in the appended claims.

What is claimed is:

1. A horn antenna system for generating a radiating signal, comprising:

a first horn antenna means having a first horn antenna and a first ground unit made of metal, for radiating a signal based on energy;

a second horn antenna means having a second horn antenna and a second ground unit made of metal, for receiving the energy and reflecting the energy to thereby generate a reflected signal to be radiated from the first horn antenna means; and a feeding means located between the first horn antenna means and the second horn antenna means, for feeding the energy to the first horn antenna means and the second horn antenna means, wherein the feeding means is a stripe line, wherein the signal and the reflected signal are combind into the radiating signal.

2. The horn antenna system as recited in claim 1, further comprising means for electrically coupling the first horn antenna means and the second horn antenna means.

3. The horn antenna system as recited in claim 1, wherein a ground plane of the feeding means is a metal plane of the first ground unit or the second ground unit.

4. A horn antenna system having a first horn antenna means having a first horn antenna and a first ground unit made of metal, for radiating a signal based on an energy; and a second horn antenna means having a second horn antenna and a second ground unit made of metal, for receiving the energy and reflecting the energy to thereby generate a reflected signal to be radiated from the first horn antenna means, comprising:

feeding means located between the first horn antenna means and the second antenna means, for feeding the first horn antenna means and the second horn antenna means, wherein a ground plane of the feeding means is the first ground unit or second ground unit.

5. The horn antenna system as recited in claim 4, further comprising means for electrically coupling the first horn antenna means and the second horn antenna means.

* * * * *